United States Patent [19]

Franke, Sr.

[11] Patent Number: 4,553,745

[45] Date of Patent: Nov. 19, 1985

[54] FABRIC CLAMPING MEANS FOR DRIVEN WORK FOLDER

[75] Inventor: John M. Franke, Sr., Glendale, Calif.

[73] Assignee: The Singer Company, Stamford, Conn.

[21] Appl. No.: 719,094

[22] Filed: Apr. 2, 1985

[51] Int. Cl.[4] ..... B42C 1/00

[52] U.S. Cl. ..... 270/45; 112/147; 112/148; 112/121.15

[58] Field of Search ..... 270/45-47, 270/51, 37; 112/147-148, 2, 121.15, 253, 254, 257

[56] References Cited

U.S. PATENT DOCUMENTS

| | | | |
|---|---|---|---|
| 1,081,206 | 12/1913 | Burnham | 112/111 |
| 2,289,472 | 7/1942 | Alfandre | 112/2 |
| 4,010,701 | 3/1977 | Helfont | 112/121.15 |
| 4,062,309 | 12/1977 | Pollmeier et al. | 112/121.15 |
| 4,104,977 | 8/1978 | Pollmeier et al. | 112/148 |
| 4,517,907 | 5/1985 | Franke, Sr. | 112/121.15 |

FOREIGN PATENT DOCUMENTS

| | | | |
|---|---|---|---|
| 15746 | 4/1971 | Japan | 112/147 |

*Primary Examiner*—E. H. Eickholt

*Attorney, Agent, or Firm*—Robert E. Smith; Edward L. Bell

[57] ABSTRACT

A clamp device is provided for gripping a fabric ply in place in a fabric folding mandrel to prevent slippage of the fabric ply relatively to the mandrel during the folding operation, and means are provided for bodily shifting the mandrel into a position facilitating proper introduction of a fabric ply thereto.

4 Claims, 7 Drawing Figures

265
266
282
280
281
244
245
248
254
261
264
270
253
268
255
250
276
257
249
263
262
267
271
259
256
272
274
241
259
258
242
273
269
275
283
243
252
253
251

FABRIC CLAMPING MEANS FOR DRIVEN WORK FOLDER

BACKGROUND OF THE INVENTION

This invention relates to improvements in a driven work folder of the type disclosed in my co-pending U.S. patent application Ser. No. 611,240, filed May 17, 1984, now U.S. Pat. No. 4,517,907. More particularly, this invention comprehends means facilitating unerring reception of fabric ply edges into the work folder and means for clamping a fabric edge within the folder and for maintaining the fabric edge positively locked into the device during the driven fabric folding operation to prevent retraction of the fabric edge and consequent incomplete folding of the fabric.

It is an object of this invention to provide in a driven work folder a driven fabric clamping device which may be actuated prior to and maintained effective during operation of the work folder positively to prevent slippage of a fabric ply edge from within the driven folder thus to insure complete fabric folding operation.

It is also an object of this invention to facilitate successful robotic manipulation of a fabric ply edge into the fabric folding guide by providing means for shifting the entire driven portion of a fabric folding guide laterally within the constraining sheath to close the space between the mouths of the driven portion and the constraining sheath prior to fabric introduction thus to eliminate unacceptable paths into which a fabric ply edge might otherwise be introduced.

With the above and additional objects and advantages in view, as will hereinafter appear, this invention will now be described with reference to the accompanying drawings of a preferred embodiment in which.

Figure 1:
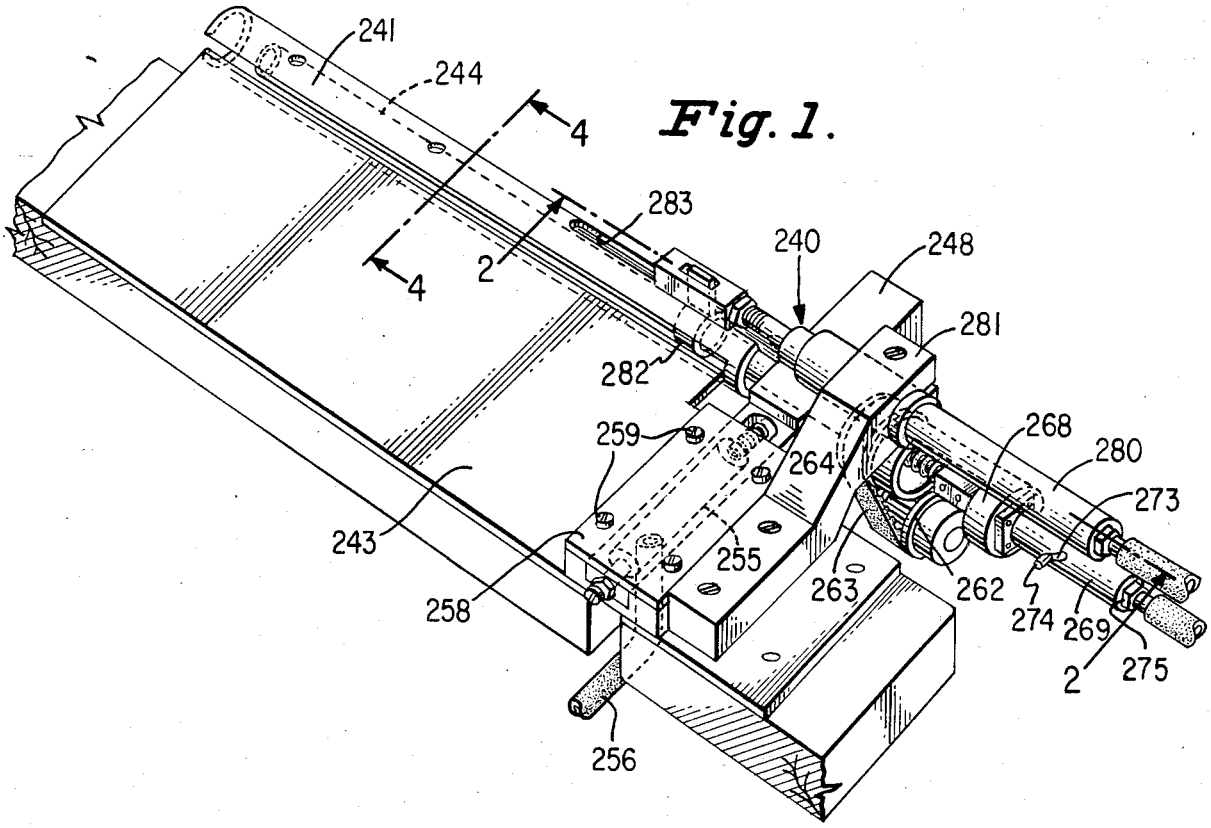
FIG. 1 is a perspective view of a driven work folder including the features of this invention.
Figure 3:
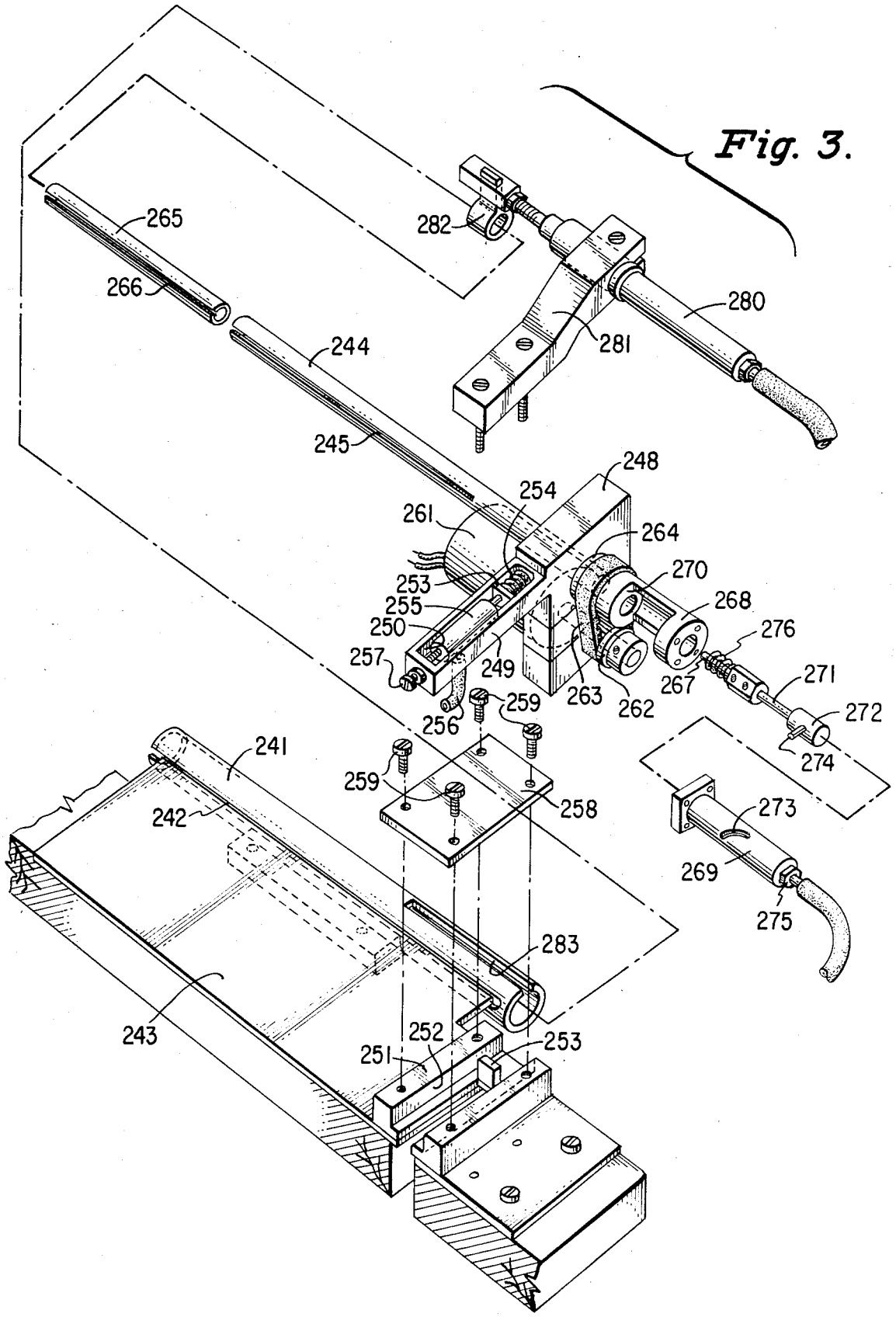

FIG. 3 is an exploded perspective view of the driven work folder of FIG. 1; and FIGS. 4A, 4B, 4C and 4D are enlarged transverse cross sectional views taken substantially along line 4—4 of FIG. 1 showing the fabric folding mandrel, fabric clamping element, and the constraining sheath of the driven work folder embodying this invention, illustrating progressive stages in the positioning of parts during a typical fabric folding operation.

Many aspects of the construction and operation of the driven work folder of this invention remain identical to that disclosed and described in my prior U.S. Pat. No. 4,517,907, filed May 17, 1984, which is incorporated herein by reference. These similar aspects include the cooperative interrelation with a fabric introducing robotic end effector, the manner in which rotation of the slotted mandrel within the constraining sheath forms a fabric fold, the manner in which ejection of the folded fabric from the folder is initiated, and the cooperative interrelation of the driven work folder with a sewing machine.

In the accompanying drawings and specification, therefore, the aspects which are identical to that disclosed in my prior U.S. Pat. No. 4,517,907, will be illustrated and described only to that extent necessary for a clear understanding of the present invention.

In the referenced U.S. Pat. No. 4,517,907, filed May 17, 1984, techniques are described wherein a surplus of fabric may be made available to the work folding rotation of the mandrel to prevent the fabric edge from being retracted from the mandrel slot. While these techniques serve adequately for certain fabrics and conditions, the present invention provides a superior solution effective over a wide range of fabrics and conditions.

Referring to the accompanying drawings, the work folding mechanism is indicated generally at 240 and includes a cylindrical folder enclosing sheath 241 formed lengthwise with a sheath slot 242. The sheath 241 is supported by attachment as by welding to a polished work supporting plate 243. Arranged within the sheath 241 is a cylindrical mandrel 244 formed with a lengthwise slot 245. A reduced diameter portion 246 of the mandrel 244 is journaled for turning movement in a bearing 247 carried by a block 248 which is guided on the support plate 243 for translatory movement transversely of the sheath 241. The block 248 is formed with an extension 249 having a vertically extending central aperture 250. Secured on the work supporting plate 243 is a guide member 251 formed with a transverse slot 252 slidably accommodating the extension 249 of the block 248. An upstanding post 253 on the guide member 251 projects upwardly through the central aperture 250 of the extension 249 and provides an abutment against which a coil spring 254 engages at one side and an air piston 255 with a compression supply line 256 engages at the other side. The air piston bears against a set screw 254 threaded into the extremity of the extension 249. A cover 258 secured over the guide member 251 by screws 259 maintains the extension 249 therein with the air piston 255 and coil spring 254 assembled therein.

The slide block 248 also carries a rotary actuator 261 provided with a drive pulley 262 connected by a clip belt 263 to a driven pulley 264 fast on the mandrel portion 246.

Fitted snuggly inside the cylindrical mandrel 244 within the sheath 241 is a cylindrical clamping member 265 which is formed with a lengthwise slot 266 of substantially the same width as that of the mandrel slot 245 and the sheath slot 242.

An extension 267 of the cylindrical clamping member 265 is journaled for turning and endwise sliding movement in the reduced diameter portion 246 of the mandrel 244 and provided exteriorly of the mandrel with means not only for interlocking the clamping member for rotation with the mandrel, but for at-will imparting a turning movement to the clamping member relatively to the mandrel so as to exert a clamping action on work fabric in the mandrel slot 245.

Figure 2:
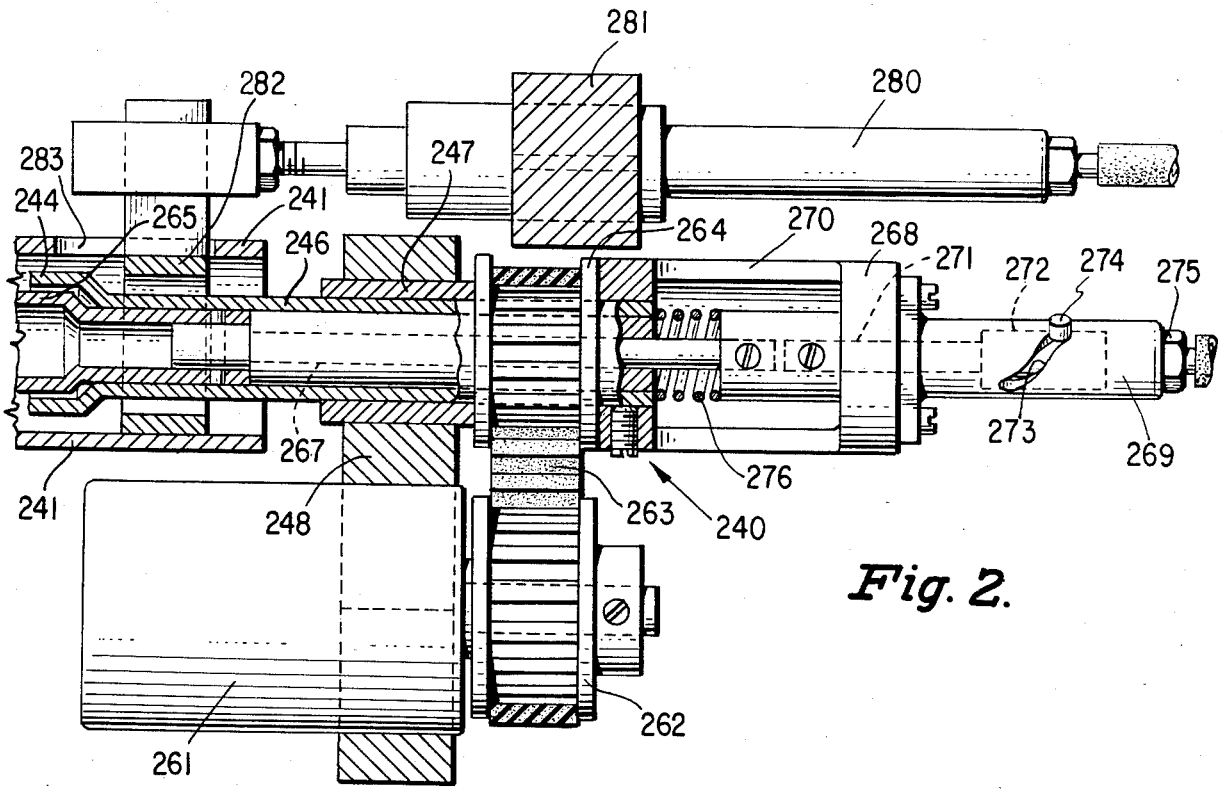
FIG. 2 is an enlarged vertical cross sectional view taken substantially along line 2—2 of FIG. 1.

One form of drive for the cylindrical clamping member 265 is illustrated in FIGS. 1, 2 and 3 and includes a connection member 268 fast on the exposed extremity 246 of the mandrel 244 and an air cylinder 269 carried by the connection member in axial alignment with the mandrel 244. In a transversely slotted central portion 270 of the connection member 268, the extension 267 of the clamping member 265 is secured to the piston rod 271 of a piston 272 which extends into the air cylinder 269. A spiral slot 273 in the air cylinder sidewall embraces a pin 274 which extends radially from the piston 272. The radial pin 274 in any given location along the spiral slot 273 interlocks the clamping member 265 and mandrel 244 for rotation together, while lengthwise movement of the piston in the air cylinder will cause the radial pin to traverse the spiral slot and influence a relative turning movement of the clamping member relatively to the mandrel. A fitting 275 at the free extremity of the air cylinder 269 accommodates connection of the rotatable air cylinder with a suitable compressed air line. Preferably admission of air under pressure to the air cylinder 269 turns the clamping member 265 into fabric gripping relation relatively to the mandrel, and a compression spring 276 acting between the mandrel portion 246 and the piston 272 releases the clamping action when air pressure is relieved.

A spring-returned cylinder and piston arrangement 280 fixed relatively to the work support plate 243 by a bracket 281 may be employed to operate a fabric engaging element 282 along a slot 283 in the sheath 241 to initiate ejection of the finished folded fabric from the work folder 240. Lateral movement of the mandrel 244 in the sheath 241 will not conflict with the fabric engaging element 282, particularly if the at-rest portion of the fabric engaging element 282 occurs along the reduced diameter portion 246 of the mandrel when the lateral movement occurs.

Figure 4A:
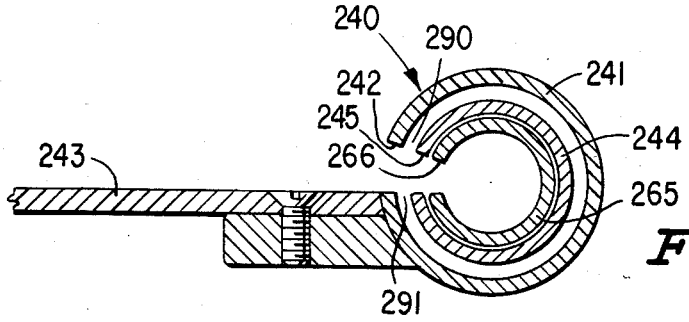

Referring to FIGS. 4A, 4B, 4C and 4D, the preferred sequence of operation of the present work folder will now be described. FIG. 4A illustrates the at-rest relationship between the sheath 241, mandrel 244 and clamping member 265, and the relative positions which these parts occupy after a folding operation ahd during ejection of folded fabric therefrom. It will be noted that the mandrel and clamping member are arranged substantially concentrically within the sheath and that the slots 266, 245 and 242 of the clamping member, mandrel and sheath are in alignment with each other.

Figure 4B:
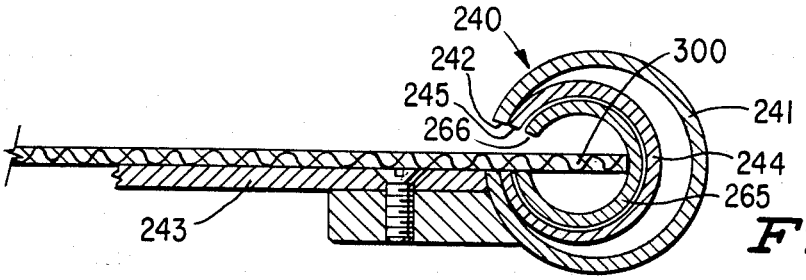

While it might be possible to introduce a fresh fabric ply edge to the folder in the position of parts shown in FIG. 4A, spaces 290 and 291 are open between the mandrel and the sheath which if entered by the fabric ply edge would result in a malfunction of the device. FIG. 4B illustrates the laterally shifted position of the mandrel and clamping member while the air cylinder 255 is actuated in which position spaces 290 and 291 are closed so as to facilitate successful robotic insertion of a fabric ply 300 through the aligned slots 242, 245 and 266.

Figure 4C:
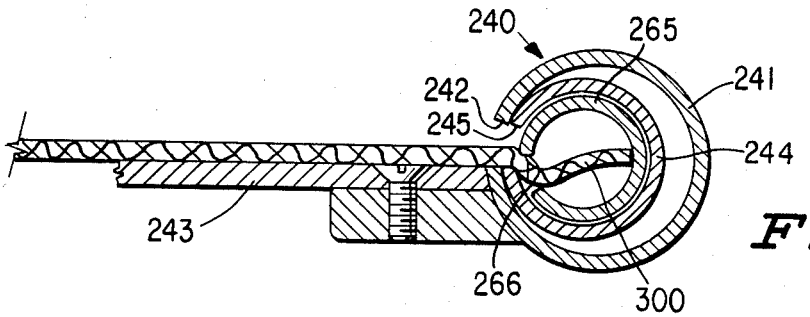

Following insertion of a fabric ply into the mandrel, FIG. 4C illustrates the succeeding operation in which actuation of air cylinder 269 causes relative rotation of the clamping member 265 in the direction of the arrow in FIG. 4C moving the slot 266 of the clamping member out of registration with the mandrel slot 245 and clamping the fabric ply firmly therebetween.

Figure 4D:
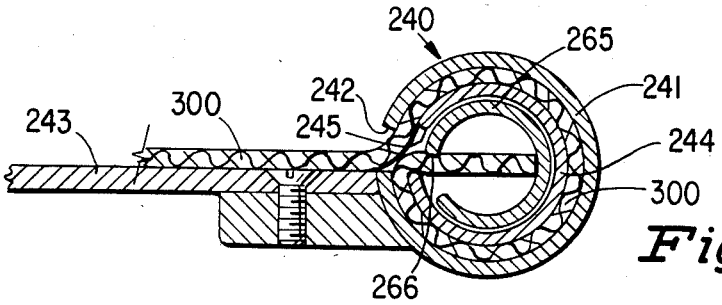

With the fabric retained in securely clamped relation against the mandrel, the mandrel and clamping member are next shifted back into substantial concentricity with the sheath by the relief of air pressure from the air piston 255 allowing the coil spring 254 to be effective and, as shown in FIG. 4D while in this relative position, the mandrel and clamping member are rotated together by the rotary actuator 261 to form the edge fold in the fabric ply.

Subsequent return of the clamping member to the relative position shown in FIG. 4A by the action of spring 276 when delivery of compressed air to the air cylinder 269 is discontinued unclamps the fabric and frees the folded ply for ejection from the folder initially by the action of the fabric engaging element 282 followed by the working feeding influence of the sewing machine.

I claim:

1. An automatically operable work fabric manipulating device for folding and delivering one edge of a fabric panel, including a mandrel rotatable about a lengthwise axis;

said mandrel being formed with a fabric accomodating slot extending parallel to the lengthwise axis thereof, and having a mouth opening at one side of said mandrel;

drive means for rotating said mandrel to form a fold in a fabric panel edge inserted in said mandrel slot, said drive means operatively connected to said mandrel adjacent one lengthwise extremity of said slot;

said slot extending continuously to the other and free extremity of said mandrel; and a sheath surrounding at least a portion of said mandrel and providing for frictional engagement of a work fabric panel interposed therebetween by the rotation of said mandrel;

the improvement which comprises fabric clamping means carried by said mandrel for rotation therewith and operating means for selectively shifting said fabric clamping means relative to said mandrel into and out of a position securely clamping a fabric panel to said mandrel.

2. An automatically operable work fabric manipulating device as set forth in claim 1 in which said mandrel comprises a hollow cylindrical member, said fabric clamping means includes a hollow cylindrical member formed with a lengthwise fabric accommodating slot, with said mandrel and fabric clamping means being arranged in concentric relationship and interconnected for rotation in unison, and in which said operating means comprises means for imparting turning movement to said fabric clamping means relatively to said mandrel to shift said mandrel and fabric clamping means slots selectively into and out of registry with each other.

3. An automatically operable work fabric manipulating device for folding and delivering one edge of a fabric panel including a hollow cylindrical mandrel rotatable about the lengthwise axis, said mandrel being formed with a fabric accommodating slot extending parallel to the lengthwise axis thereof, and having a mouth opening at one side of said mandrel, drive means for rotating said mandrel to form a fold in a fabric panel edge inserted in said mandrel slot, said drive means operatively connected to said mandrel adjacent one lengthwise extremity of said slot, said slot extending continuously to the other and free extremity of said mandrel; and a stationary sheath surrounding at least a portion of said mandrel and providing for frictional engagement of a work fabric panel interposed therebetween by the rotation of said mandrel, said sheath being formed with a lengthwise fabric accommodating slot; the improvement which comprises means for shifting said mandrel laterally into contact with said sheath with said mandrel slot contiguous to said sheath slot for facilitating insertion of a fabric panel edge through said slots and into said mandrel, and means for shifting said mandrel laterally to a location substantially centrally of said sheath after fabric panel edge insertion therein and prior to operation of said mandrel rotating means to form a fold in said fabric panel edge.

4. An automatically operable work fabric manipulating device as set forth in claim 3, the improvement which further comprises a fabric clamping means carried by said mandrel for rotation therewith, and operating means for selectively shifting said clamping means relatively to said mandrel into an effective position securely clamping a fabric panel to said mandrel after a fabric panel edge has been introduced into said mandrel slot and while said mandrel is shifted laterally into contact with said sheath, and means for maintaining said clamping means effective during lateral shift of said mandrel to a location substantially centrally of said sheath and during rotation of said mandrel to form a fold in said clamped fabric panel edge.

* * * * *